United States Patent [19]

Stäheli et al.

[11] Patent Number: 4,998,325

[45] Date of Patent: Mar. 12, 1991

[54] CARD HAVING A TRANSVERSE CONVEYOR WITH A TRAPEZOIDALLY CROSS-SECTIONED SHOULDER, FOR CONVEYING A WEB LATERALLY AWAY FROM THE CARD

[75] Inventors: Paul Stäheli, Wilen; Giuseppe Verzilli, Wiesendangen, both of Switzerland

[73] Assignee: Rieter Machine Works, Ltd., Winterthur, Switzerland

[21] Appl. No.: 394,590

[22] Filed: Aug. 16, 1989

[30] Foreign Application Priority Data

Aug. 16, 1988 [DE] Fed. Rep. of Germany ..... 3827822

[51] Int. Cl.[5] ..... D01G 15/46; D01G 15/02

[52] U.S. Cl. ..... 19/106 R; 19/150; 19/65 CR

[58] Field of Search ..... 19/98, 103, 10 CR, 106 A, 19/145.7, 150, 152, 153, 159 R, 159 A, 241, 244, 248, 249, 252, 253, 65 CR

[56] References Cited

U.S. PATENT DOCUMENTS

| | | | |
|---|---|---|---|
| 207,626 | 9/1878 | Sargent | 19/244 X |
| 2,563,756 | 8/1951 | Swallow | 19/150 X |
| 2,870,490 | 1/1959 | Freedlander | 19/153 |
| 3,345,700 | 10/1967 | Kalwaites | 19/106 R |
| 3,825,975 | 7/1974 | Stäheli | 19/150 |
| 3,946,464 | 3/1976 | Meinke | 19/150 |
| 4,615,170 | 10/1986 | Walter | 19/248 X |
| 4,692,967 | 9/1987 | Dolan | 19/244 |
| 4,722,118 | 2/1988 | Fahmueller | 19/106 R |

FOREIGN PATENT DOCUMENTS

| | | |
|---|---|---|
| 1029732 | 5/1958 | Fed. Rep. of Germany . |
| 1182143 | 11/1964 | Fed. Rep. of Germany . |
| 1187288 | 2/1965 | Fed. Rep. of Germany . |
| 1481024 | 11/1969 | Fed. Rep. of Germany . |
| 1685617 | 9/1971 | Fed. Rep. of Germany . |
| 1102417 | 5/1986 | Japan . |

OTHER PUBLICATIONS

PFAB, Rud: Gummiforderbander mit Seitenwanden, G+A Plastische Massen, 1959, Jg. 12, pp. 872, 878.

*Primary Examiner*—Werner H. Schroeder
*Assistant Examiner*—Ismael Izaguirre
*Attorney, Agent, or Firm*—Kenyon & Kenyon

[57] ABSTRACT

The card for producing a fiber includes a swift and a doffer which takes the carded fibers off the swift and supplies them to a nip formed between at least two rotating rollers. The fiber web emerging from the nip is deposited on the top run of a transverse conveyor which moves axially of the rolls between guide rollers in order to convey the fiber web laterally away from the card. The conveyor has a shoulder on at least one longitudinal side against which the fiber web may abut during travel along the transverse conveyor.

7 Claims, 2 Drawing Sheets

CARD HAVING A TRANSVERSE CONVEYOR WITH A TRAPEZOIDALLY CROSS-SECTIONED SHOULDER, FOR CONVEYING A WEB LATERALLY AWAY FROM THE CARD

BACKGROUND OF THE INVENTION

This invention relates to a card having a transverse conveyor.

As is known, various types of cards have been known for the production of a fiber sliver. For example, German Auslegeschrift 16 85 617 and corresponding U.S. Pat. No. 3,481,004 describe a card for producing a sliver having a swift and a doffer which takes the carded fibers off the swift and supplies them to a nip formed between at least two rotating rolls. The fiber web emerging from the nip is deposited on the top run of a transverse conveyor which moves in the axial direction of the rolls between guide rollers disposed near the axial ends of the rolls and conveys the fiber web to one axial end of the rolls.

In practice, it has been found very advantageous to use a transverse conveyor for guiding the fiber web to one end face of a card, after which the web is turned through about 90° at the turning place of the transverse conveyor and is conveyed e.g. through a measuring hopper.

In order to turn the fiber web by means of the transverse conveyor, the conveyor is frequently disposed to run in a horizontal plane but so that the surface of the top run is at an angle of about 30° transversely to the direction of travel.

In practice, in the construction of many cards equipped with such a transverse conveyor, particularly where the surface of the top run is inclined, a stationary guide plate is disposed on the longitudinal side of the top run facing the doffer, and so to speak, covers the gap between the top run and the adjacent structure or rolls. However, it has been found that fiber packets occur on the transverse conveyor at the edge of the fiber web. These packets may work loose and travel with the fiber web, and this has an adverse effect on the subsequent processing of the fiber. Such fiber packets are therefore undesirable.

SUMMARY OF THE INVENTION

Accordingly, it is an object of the invention to eliminate the occurrence of fiber packets in cards.

It is another object of the invention to improve the quality of a yarn made from a sliver produced on a card.

It is another object of the invention to avoid impairment of a fiber web on a transverse conveyor supplied with a carded web.

Briefly, the invention provides a card with a swift for carding fibers, a pair of rollers defining a nip, a doffer for transferring carded fibers from a swift to the nip to form a fiber web and a transverse conveyor having a top run for receiving a fiber web from the nip of the rollers. In accordance with the invention, the top run extends in parallel to the rollers and has a shoulder extending longitudinally thereof on a side facing the swift for guiding the fiber web.

The invention is based on the discovery that the guide plate is the actual cause of fiber packets, since dirt particles accumulate between the guide plate and the transverse conveyor and because the guide plate constitutes a stationary surface disposed near the rotating surface of the guide belt. This is the ultimate cause of the formation of fiber packets.

The invention is also based on the discovery that twisting does not occur in the fiber web if there is no slip between the guide surface and the top run of the transverse conveyor. This can be avoided by forming a shoulder on the outer surface of the transverse conveyor on the longitudinal edge facing the doffer. The shoulder thus always moves with the transverse conveyor and prevents undesired fiber packets from forming.

Consequently, the rotating shoulder, which more particularly constitutes a uniform, i.e. one-piece, structure with the transverse conveyor, extends over the entire periphery of the endless transverse conveyor.

The transverse conveyor can be used with cards in which the top run of the transverse conveyor is inclined at an angle and also in cards where the surface of the top run travels in a horizontal plane. In these constructions, in particular, and also in inclined constructions, it is advantageous if the longitudinal side of the transverse conveyor remote from the swift has a second shoulder, likewise disposed on the outer surface which conveys the fiber web. The second shoulder likewise extends over the entire periphery of the transverse conveyor and rotates therewith. The two shoulders together with the top run of the transverse conveyor form a sort of continuous channel which efficiently guides the fiber web on delivery, for example, to a hopper.

These and other objects and advantages of the invention will become more apparent from the following detailed description taken in conjunction with accompanying drawings wherein:

DESCRIPTION OF THE PREFERRED EMBODIMENTS

Figure 1:
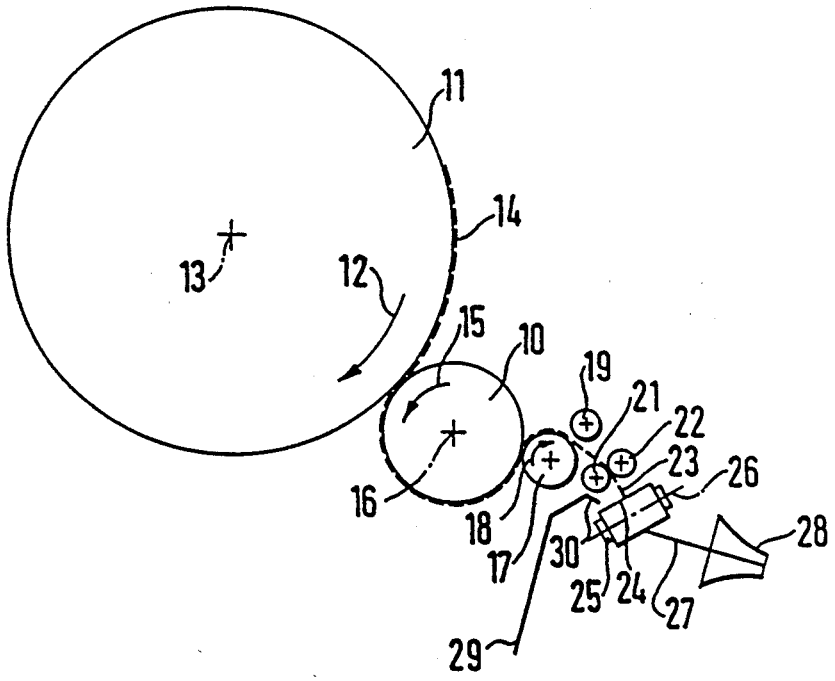
FIG. 1 diagrammatically illustrates a side view of a known card.

Referring to FIG. 1, the known card has a swift 11 which during operation rotates in the direction indicated by the arrow 12 around an axis 13. The swift 11, carries pin clothing (not shown) in known manner. Carded fibers 14 are carried on the points of the pins and form a very fine combed web. A conventional doffer 10 is disposed to the right of the swift 11 and rotates in the direction indicated by the arrow 15 around an axis 16. The doffer 16 also has a pin clothing in known manner (not shown). The points of the pins receive the fiber web delivered by the swift 11 and convey the web to a delivery roll 17, which e.g. can be grooved and rotates in the direction indicated by the arrow 18. A guide roll 19 is disposed opposite the web-delivery roll 17 and rotates in the opposite direction. The rolls 17, 19 convey the fiber web to a nip between two pinch rolls 21, 22 which are highly polished and have two or three grooves, the surfaces of which are helical and have a pitch such that each groove makes about two turns in all along the length of the rolls 21, 22.

The doffer 10, the web-receiving roll 17, the guide roll 19 and the pinch rolls 21, 22 all extend over the entire width of the swift. The fiber web 23 coming out of the nip between the rolls 21, 22 is deposited on the top run 24 of a transverse conveyor moving in the axial direction of the transverse rolls, i.e., at right angles to and into the plane of the drawing. The transverse conveyor is spaced from the rolls 21, 22 and is guided over rollers 25, each disposed adjacent an axial end of the rolls 21, 22 and rotating around a respective axis 26. For simplicity, FIG. 1 shows only one roller 25 and its axis 26. The top run 24 therefore moves in a horizontal direction, but is inclined to the horizontal plane in the transverse direction. In this manner, when the total width of the nip between the rolls 21, 22 is about 1 meter, the fiber web is laterally compressed and guided along the roller at the end of the transverse conveyor so as to produce a sliver 27 from two to five centimeters thick. The sliver 27 is supplied in known manner to a measuring hopper 28.

A bent guide plate 29 is disposed between the lower pinch roll 21 and the longitudinal side of the transverse conveyor facing the swift 11 and is stationary with respect to the card frame. The guide plate, i.e., the guide strip 30 disposed adjacent the transverse conveyor, occasionally causes fiber packets to form, as described in detail hereinbefore.

Figure 2:
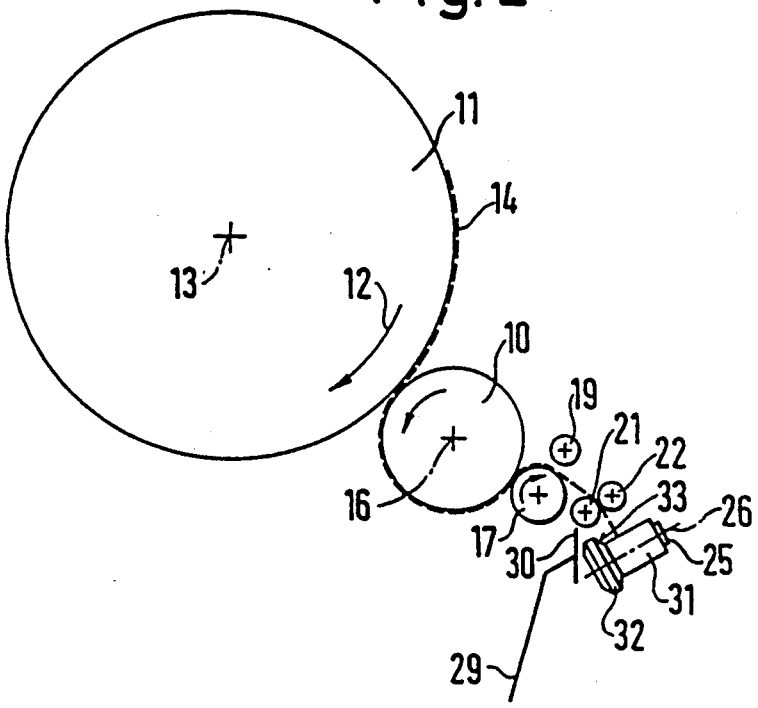
FIG. 2 diagrammatically illustrates a side view of a card constructed in accordance with the invention.

Referring to FIG. 2, wherein like reference characters indicate like parts as above, the relative arrangement of swift 11, doffer 10, delivery roll 17, guide roll 19 and pinch rolls 22, of the card are as in FIG. 1. In this example, a transverse conveyor 31 runs round two guide rollers 25, only one of which is shown in the drawing.

Figure 3:
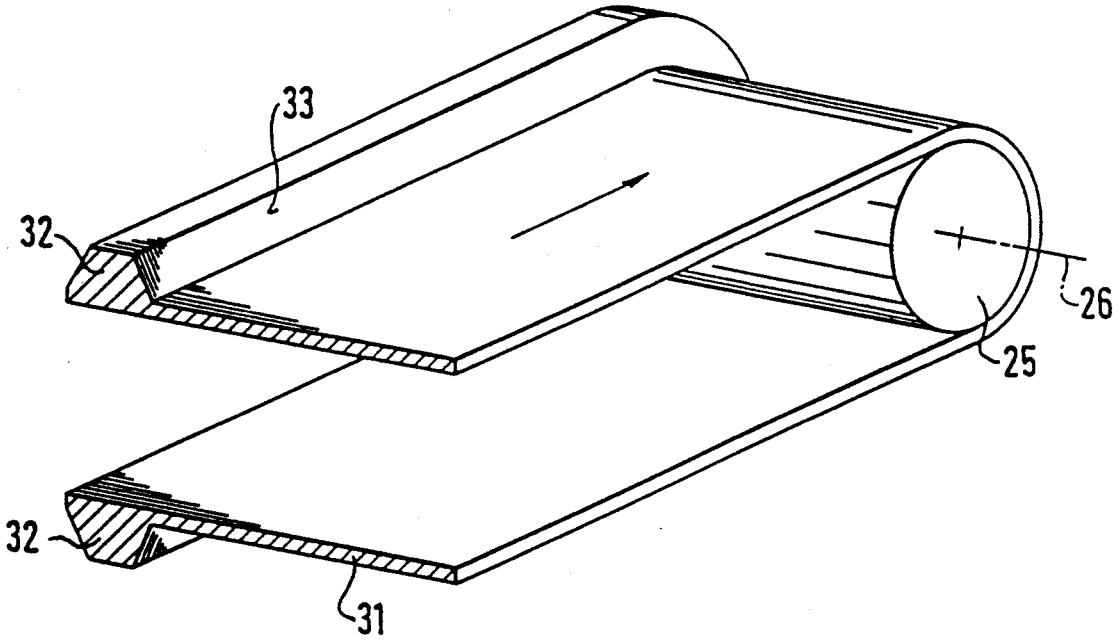
FIG. 3 illustrates a part perspective view of a transverse conveyor having a shoulder in accordance with the invention.

Referring to FIGS. 2 and 3, the transverse conveyor 31 has a top run for receiving a fiber web from the nip of the rollers 21, 22 which extends parallel to the rollers 21, 22 and which has a rotating shoulder 32 extending longitudinally of a side facing the swift 11. The bent guide plate 29 is now disposed so that the strip 30 facing the transverse conveyor lies parallel to and at a short distance from the outer side of the shoulder 32 on the top run of the transverse conveyor 31.

The shoulder 32 is of trapezoidal cross-section with an inner side 33 which guides the web 23 instead of the guide plate 29 in FIG. 1, but differs in that the shoulder 32 travels with the transverse conveyor 30, so that the fibers cannot become twisted. The shoulder 32 has a height perpendicular to the top run in a range of from 5 to 20 millimeters while the surface remote from the swift 11 defines an angle of from 80° to 150° with the top run. The shoulder 32 also has a height-to-width cross-sectional ratio of from 1:4 to 1:2.

Figure 4:
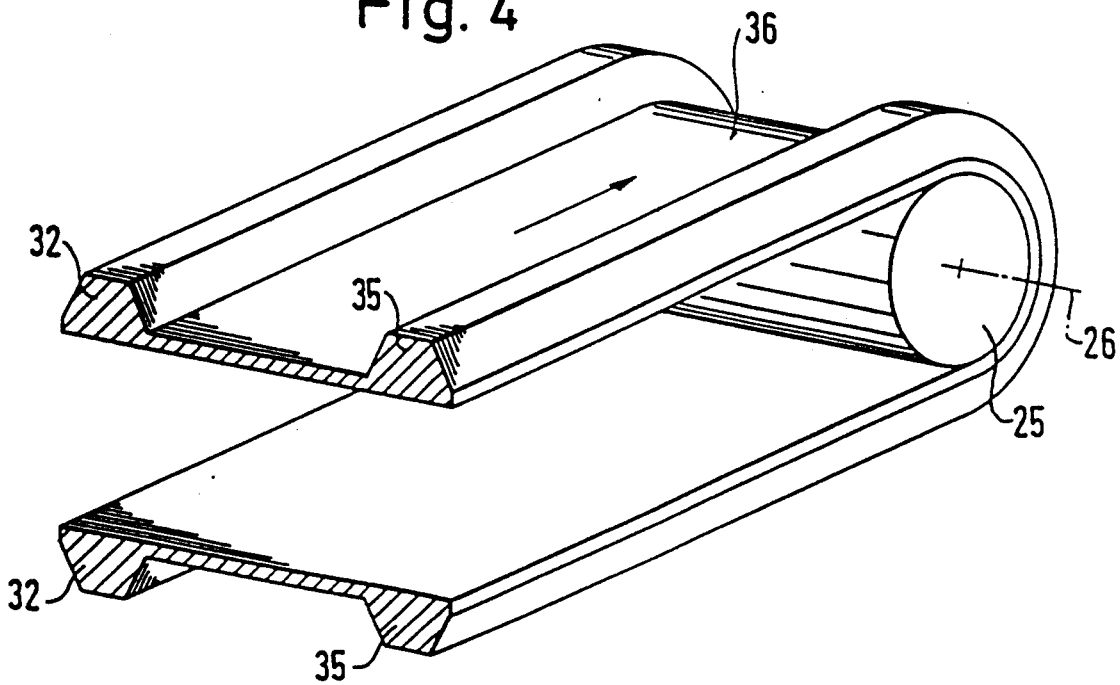
FIG. 4 illustrates a modified transverse conveyor constructed in accordance with the invention.

Referring to FIG. 4, the transverse conveyor may include a second shoulder 35 which is disposed on the longitudinal side remote from the swift 11 and, like shoulder 32, rotates with the transverse conveyor. The second shoulder 35 also helps to prevent fiber packets from forming. Admittedly, it is less likely that fiber packets will form on the longitudinal side of the transverse conveyor remote from the swift than on the side facing the swift, but here also there is normally a stationary structure which can result in fiber packets if the fiber web deposited on the transverse conveyor is excessively wide.

As FIG. 4 also shows, the transverse conveyor and two shoulders 32, 35, form a sort of channel 36 on the guide roller 25 and to some extent guide the fiber web during movement round the guide roller 25 and protect the web from damage on delivery to a hopper 28 (FIG. 1).

The invention thus provides a card for producing sliver in which fiber packets are substantially eliminated. In addition, the invention provides a card in which an accumulation of dirt is avoided between a moving fiber web and associated conveying parts. As a result, the yarn which is subsequently processed from the fiber web has an improved quality.

What is claimed is:

1. A card comprising a swift for carding fibers;

a pair of rollers defining a nip therebetween;

a doffer for transferring carded fibers from said swift to said nip to form a fiber web; and a transverse conveyor spaced from said rollers having a top run for receiving a fiber web from said nip of said rollers, said top run extending in parallel to said rollers to turn the web in a different toward one end of said rollers and having a shoulder extending longitudinally thereof on a side facing said swift for guiding the fiber web,

2. A card as set forth in claim 1 wherein said shoulder has a trapezoidal cross-section.

3. A card as set forth in claim 1 wherein said shoulder has a height perpendicular to said top run in a range of from 5 to 20 millimeters.

4. A card as set forth in claim 1 wherein said shoulder has a surface remote from said swift defining an angle of from 80° to 150° with said top run.

5. A card as set forth in claim 1 wherein said shoulder has a height-to-width cross-sectional ratio of from 1:4 to 1:2.

6. A card as set forth in claim 1 wherein said top run has a second shoulder parallel to and spaced from said first shoulder to define a channel for the fiber web.

7. A card comprising a swift for carding fibers;

a pair of rollers defining a nip therebetween;

a doffer for transferring carded fibers from said swift to said nip to form a fiber web; and a transverse conveyor spaced from said rollers and having a top run for receiving a fiber web from said nip of said rollers, said top run extending in parallel to said rollers and having a shoulder of trapezoidal cross-section extending longitudinally thereof on a side facing said swift for guiding the fiber web.

* * * * *

UNITED STATES PATENT AND TRADEMARK OFFICE

CERTIFICATE OF CORRECTION

PATENT NO. : 4,998,325

DATED : March 12, 1991

INVENTOR(S) : Paul Staheli, et al

It is certified that error appears in the above-identified patent and that said Letters Patent is hereby corrected as shown below:

Column 4, line 30 change "different" to -direction-

Signed and Sealed this

Fifteenth Day of September, 1992

*Attest:*

DOUGLAS B. COMER

*Attesting Officer*

*Acting Commissioner of Patents and Trademarks*